US007753724B2

(12) United States Patent
Gong et al.

(10) Patent No.: US 7,753,724 B2
(45) **Date of Patent: *Jul. 13, 2010**

(54) STACKED ELECTRICAL CONNECTOR WITH IMPROVED CONTACTS ARRANGEMENT

(75) Inventors: Hong-Bin Gong, Kunshan (CN); Zhong-Hua Yao, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/387,281

(22) Filed: Apr. 30, 2009

(65) Prior Publication Data

US 2009/0275240 A1 Nov. 5, 2009

(30) Foreign Application Priority Data

Apr. 30, 2008 (CN) ..... 2008 2 0035893 U

(51) Int. Cl.
*H01R 13/66* (2006.01)

(52) U.S. Cl. ..... 439/541.5

(58) Field of Classification Search ..... 439/541.5, 439/607.35, 607.38, 607.39, 607.4, 607.55, 439/79, 540.1

See application file for complete search history.

(56) References Cited

U.S. PATENT DOCUMENTS 2,863,131 A * 12/1958 Carlzen et al. ..... 439/56
5,244,414 A * 9/1993 Peloza ..... 439/567
5,697,805 A * 12/1997 Orstad et al. ..... 439/374
5,755,595 A * 5/1998 Davis et al. ..... 1/1
6,027,375 A * 2/2000 Wu ..... 439/607.02
6,083,044 A * 7/2000 Wang et al. ..... 439/567
6,086,430 A 7/2000 Amoni et al.
6,095,861 A * 8/2000 Lin et al. ..... 439/607.25
6,126,481 A * 10/2000 Wu et al. ..... 439/541.5
6,334,793 B1 1/2002 Amoni et al.
6,347,961 B2 * 2/2002 Zhu et al. ..... 439/607.01
6,368,151 B1 * 4/2002 Chen et al. ..... 439/541.5
6,394,846 B1 * 5/2002 Belopolsky et al. .... 439/620.11
6,540,563 B1 * 4/2003 Hu et al. ..... 439/676
6,561,847 B1 * 5/2003 Xiang et al. ..... 439/541.5
D482,650 S * 11/2003 Ludwick ..... D12/400
D482,659 S * 11/2003 Zhang ..... D13/147
7,044,790 B2 * 5/2006 Zhu et al. ..... 439/607.27
2004/0229502 A1 * 11/2004 Hu et al. ..... 439/541.5
2007/0232132 A1 * 10/2007 Ling et al. ..... 439/541.5
2007/0293083 A1 * 12/2007 Wang et al. ..... 439/541.5
2009/0305555 A1 * 12/2009 Wang et al. ..... 439/541.5

* cited by examiner

*Primary Examiner*—Michael C Zarroli
*Assistant Examiner*—Harshad C Patel
(74) *Attorney, Agent, or Firm*—Wei Te Chung; Andrew C. Cheng; Ming Chieh Chang

(57) ABSTRACT

A stacked electrical connector includes a front mating face, an insulative housing comprising and a plurality of contacts. The insulative housing has a first housing and a second housing arranged in an up-to-down direction. The first housing defines a plurality of inserting ports. The second housing defines a receiving space. The contacts include a plurality of first contacts and second contacts. The first contacts each has a first contact portion extending into the inserting port and a first soldering tail extending out of the insulative housing downwardly. The second contacts each has a second contact portion extending into the receiving space and a second soldering tail extending out of the insulative housing downwardly. All the first soldering tails are arranged closer to the mating face than the second soldering tails.

15 Claims, 5 Drawing Sheets

STACKED ELECTRICAL CONNECTOR WITH IMPROVED CONTACTS ARRANGEMENT

BACKGROUND OF THE INVENTION

1. Field of the Invention

The present invention relates to a stacked electrical connector, more particularly to a stacked electrical connector with an improved contacts arrangement.

2. Description of Related Art

With rapid development of the electronic industry, more and more electrical connectors are employed on peripherals, such as computers, printers, PDA, etc, to transmit various signals with each other. A stacked electrical connector includes an insulative housing, a plurality of contacts retained in the insulative housing, and a metal shell covering the insulative housing. The insulative housing defines an upper receiving space and a lower receiving space disposed under the upper receiving space. The contacts includes a plurality of first contacts and second contacts. The first contacts each has a first contact portion extending into the upper receiving space and a soldering tail extending downwardly and out of the insulative housing. The second contacts each has a second contact portion extending into the lower receiving space and a second soldering tail extending downwardly and out of the insulative housing. However, all the first soldering tails are located behind the second soldering tails. Thereby, the first contacts would be too long.

Hence, a stacked electrical connector is desired to overcome the disadvantage of the prior art.

BRIEF SUMMARY OF THE INVENTION

According to another aspect of the present invention, a stacked electrical connector defines a front mating face and a mounting face, and comprises an insulative housing comprising a first housing and a second housing arranged in an up-to-down direction, the first housing defining a plurality of inserting ports recessed from the mating face, the inserting ports being arranged in a row along a left-to-right direction perpendicular to the up-to-down direction, the second housing defining a receiving space recessed from the mating face; and a plurality of contacts comprising a plurality of first contacts and a plurality of second contacts, wherein the first contacts each has a first securing portion retained in the first housing, a first contact portion extending into the inserting port from the first securing portion, a first soldering tail extending out of the insulative housing downwardly, and a first connecting portion between the first securing portion and the first soldering tail, wherein the second contacts each has a second securing portion retained in the second housing, a second contact portion extending into the receiving space from the second securing portion, a second soldering tail extending out of the insulative housing downwardly, and a second connecting portion between the second securing portion and the second soldering tail; wherein all the first soldering tails are arranged closer to the mating face than the second soldering tails.

According to another aspect of the present invention, a stacked electrical connector defines a front mating face and a mounting face perpendicular to the mating face, and comprises an insulative housing having a first housing and a second housing arranged in an up-to-down direction, the first housing defining a plurality of inserting ports recessed from the mating face; and a plurality of contacts comprising a plurality of first contacts and a plurality of second contacts, wherein the first contacts each has a first securing portion retained in the first housing, a first contact portion extending into the inserting port from the first securing portion, a first soldering tail extending out of the insulative housing, and a first connecting portion between the first securing portion and the first soldering tail, wherein the second contacts each has a second securing portion retained in the second housing, a second contact portion extending into the receiving space from the second securing portion, a second soldering tail extending downwardly and out of the insulative housing, and a second connecting portion between the second securing portion and the second soldering tail; wherein the second housing defines a base portion and a mounting pedestal protruding backwardly from the base portion, the mounting surface is disposed on a bottom portion of the mounting pedestal, the first soldering tails and the second soldering tails are fixed on the mounting pedestal in a left-to-right direction; wherein the mounting pedestal further defines a plurality of level retaining slots, the second connecting portion each includes a level portion connecting with the second soldering tail, wherein the level portions are received in the retaining slots.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
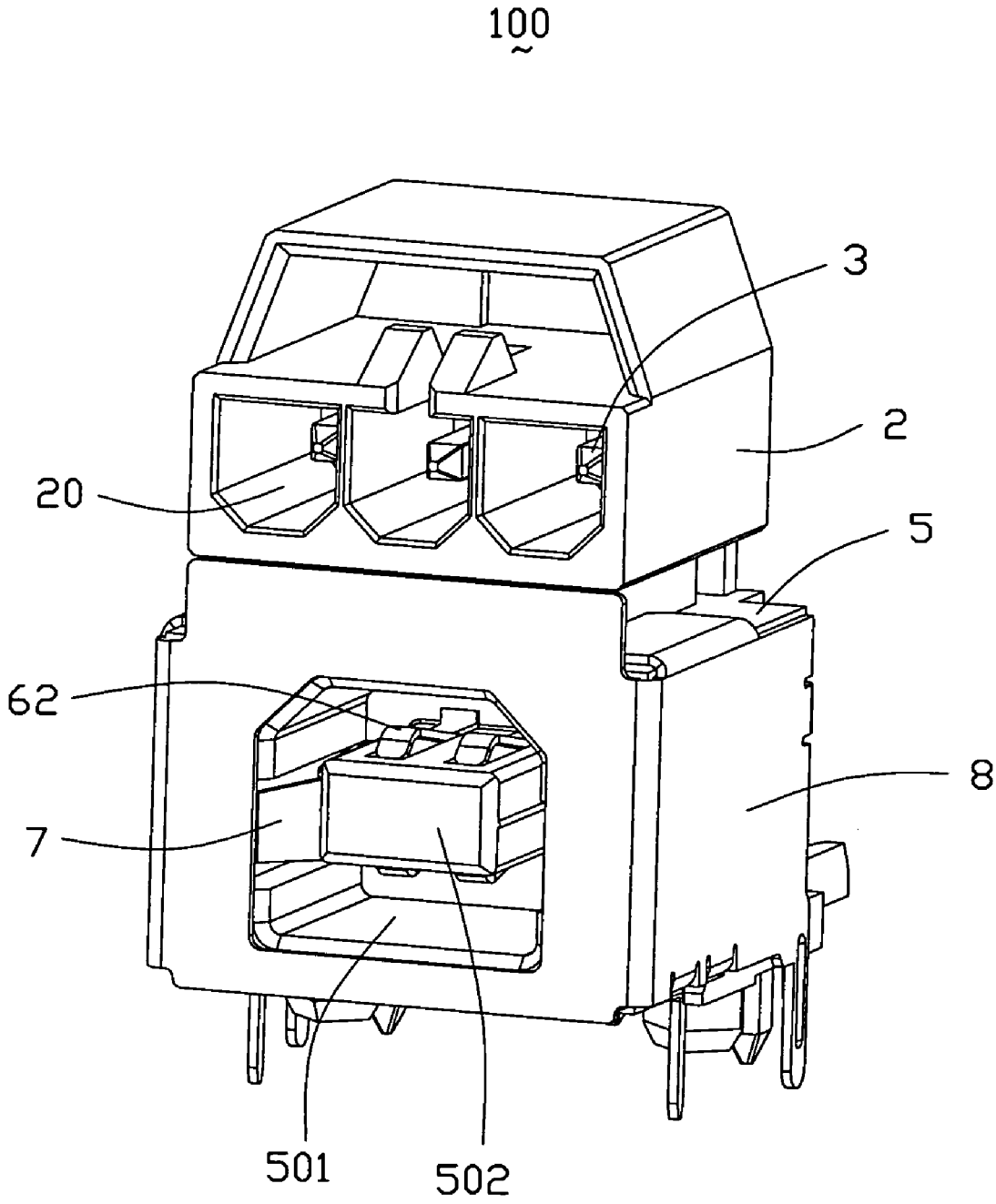
FIG. 1 is a perspective view of a stacked electrical connector according to the preferred embodiment of the present invention.
Figure 2:
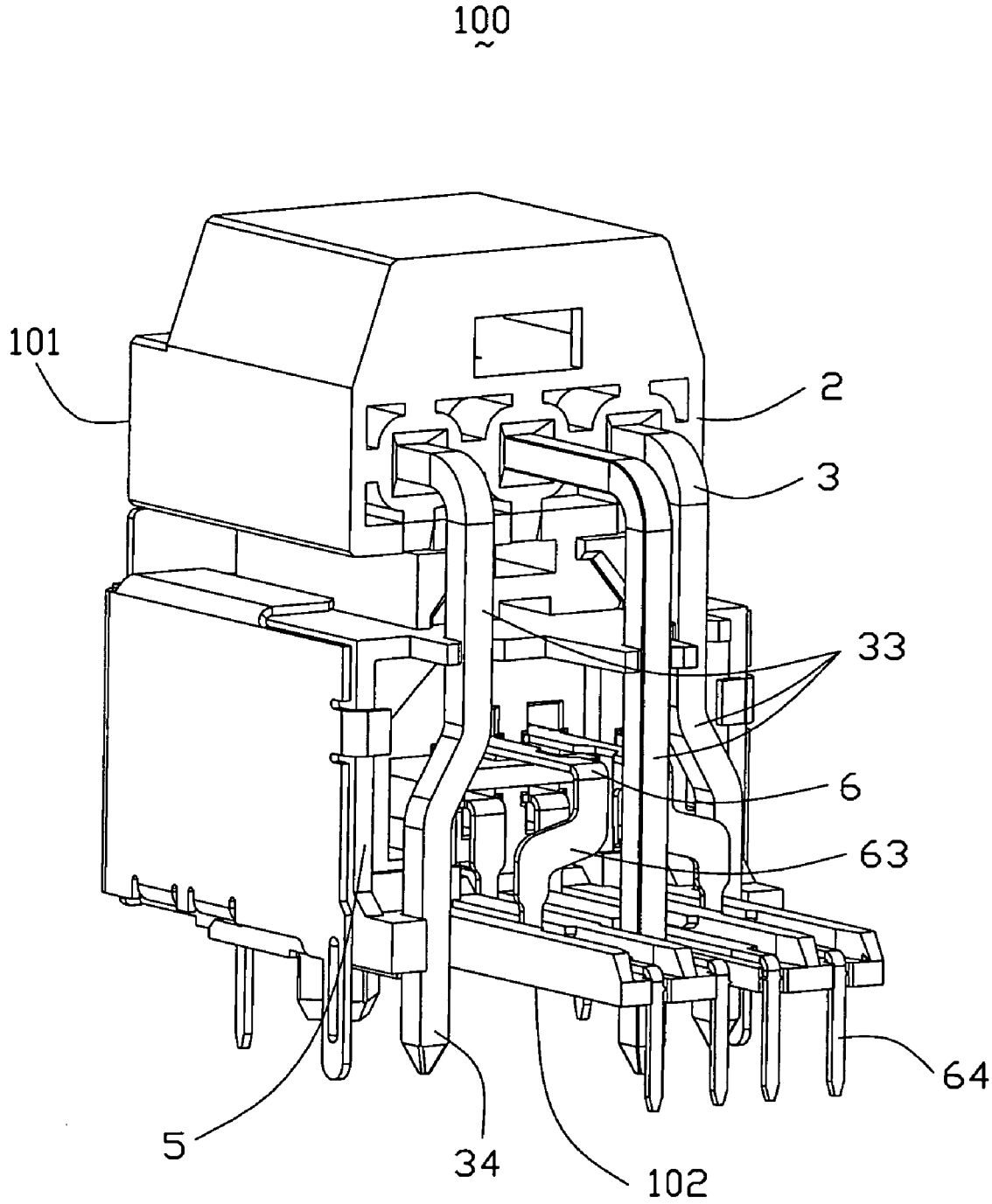
FIG. 2 is a rear view of the stacked electrical connector.
Figure 3:
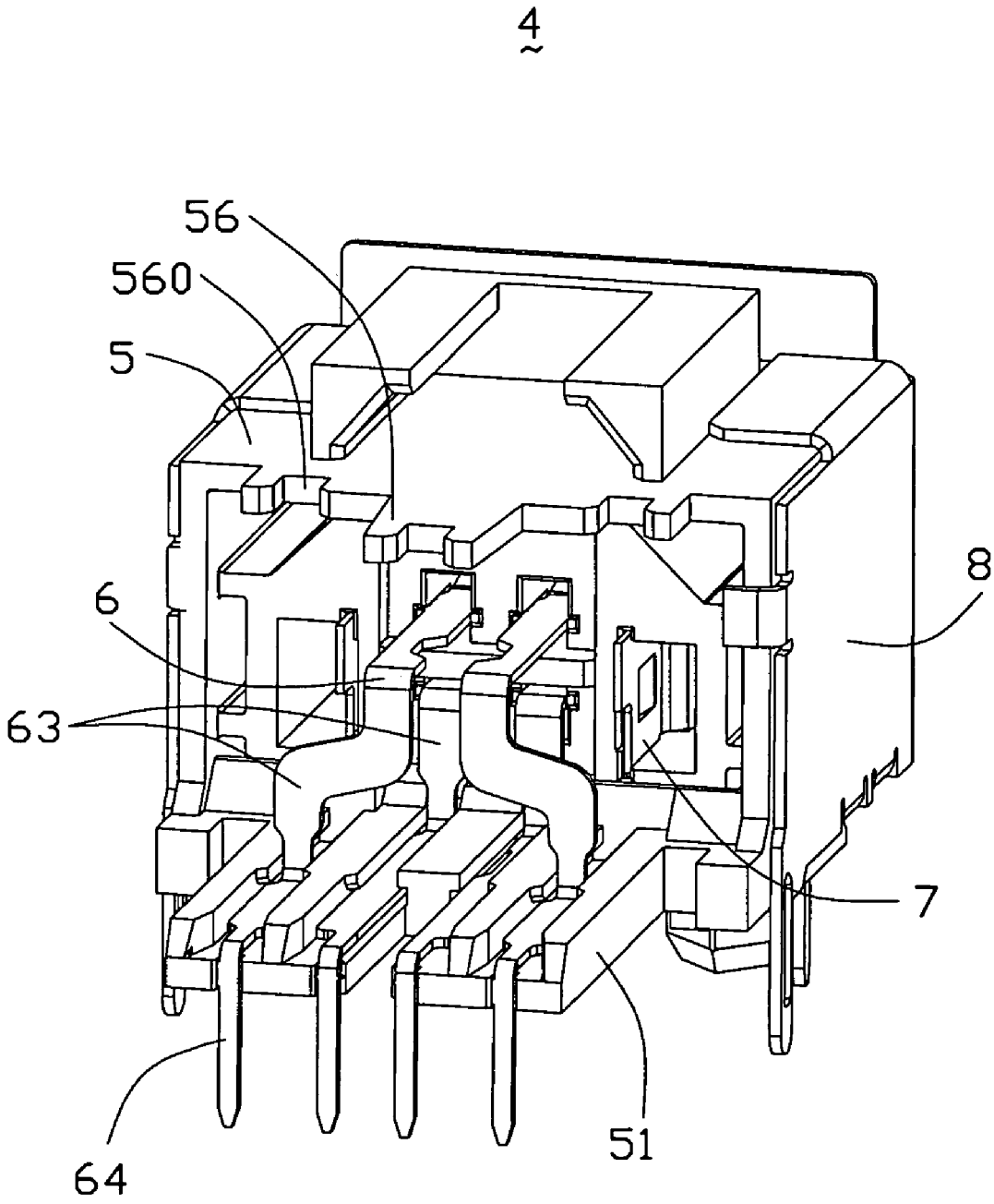
FIG. 3 is a perspective view of a second electrical connector of the stacked electrical connector.
Figure 4:
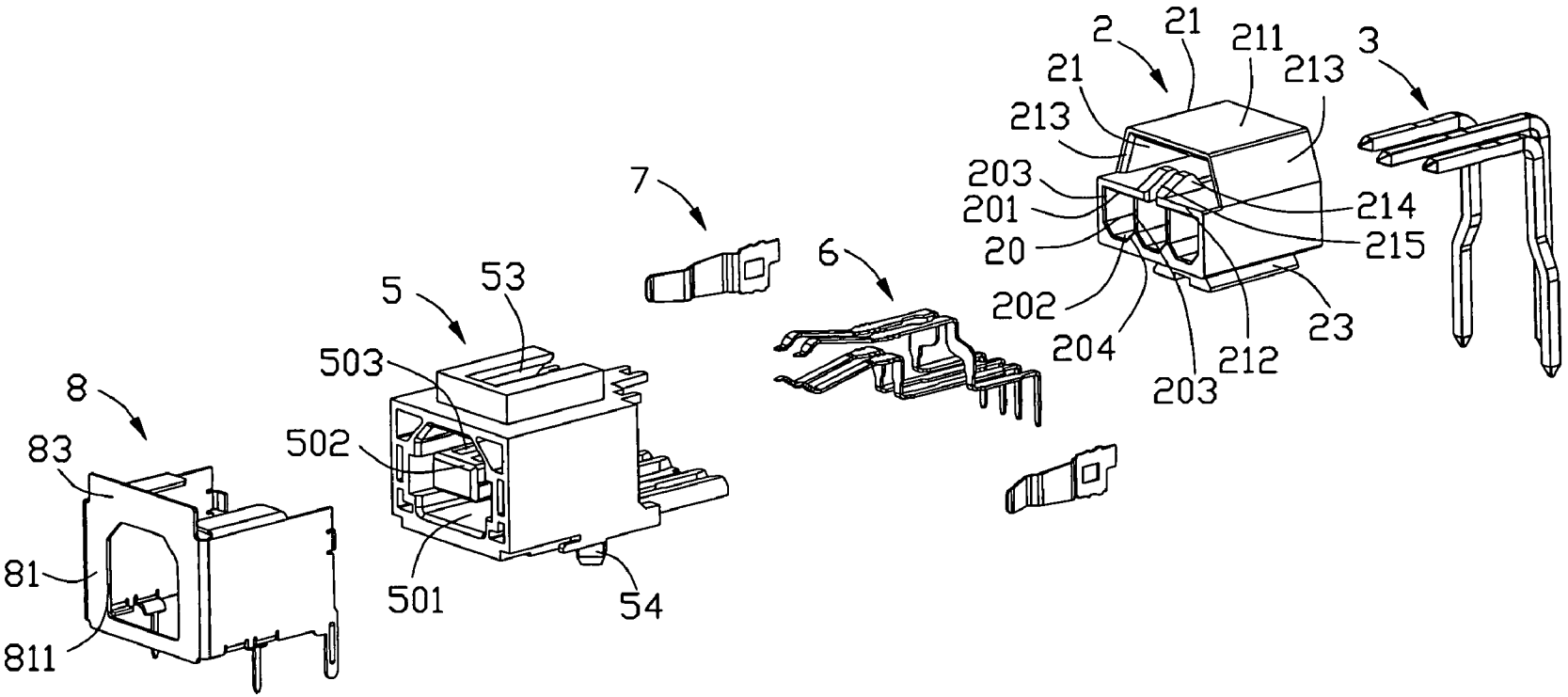
FIG. 4 is an exploded view of the stacked electrical connector.
Figure 5:
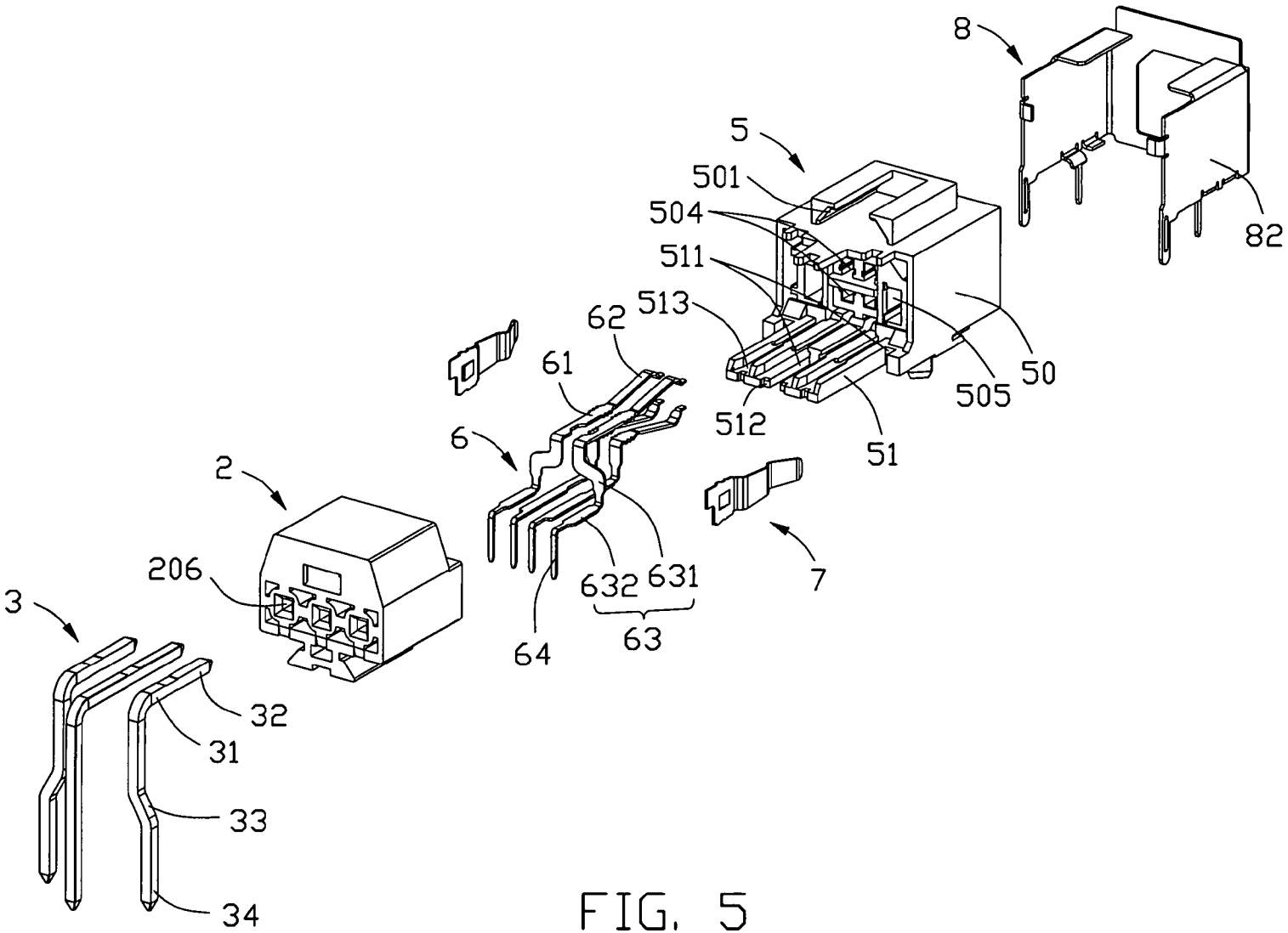
FIG. 5 is another exploded view of the stacked electrical connector.

Referring to FIGS. 1-5, a stacked electrical connector 100 for insertion of a power plug (not shown) and a standard USB 2.0 B type plug (not shown). The stacked electrical connector 100 includes an insulative housing having a first housing 2 and a second housing 5 retained on a bottom portion of the first housing 2, a plurality of first contacts 3 retained in the first housing 2, a plurality of second contacts 6 retained in the second housing 5, a pair of metal springs 7 retained in the second housing 5, and a metal shell 8 covering the second housing 5. The stacked electrical connector 100 defines a front mating face 101 and a mounting face 102 perpendicular to the mating face 101. The first housing 2 and the first contacts 3 constitute a first electrical connector. The second housing 5, the second contacts 6 and the shell 8 constitute a second electrical connector.

The firs housing 2 is narrower than the second housing 5 along a left-to-right direction. The first housing 2 has a swallow-tailed block 23 at bottom thereof. The second housing 5 defines a swallow-tailed recess 53 to engage with the swallow-tailed block 23 for fixing the first housing 2 and the second housing 5 together. The first housing 2 is fixed on the second housing 5 in a back-to-front direction. The first housing 2 and the second housing 5 can be formed as one piece insulator in other embodiment.

The first electrical connector is a power jack. The first housing 2 includes three inserting ports 20 recessed from the mating face 101, a cavity 21 located at an upper portion of the inserting ports 20 for receiving the power plug, and three passages 206 extending therethrough and communicating with inserting ports 20. All the inserting ports 20 are arranged in a row along the left-to-right direction and each is defined by six-sided confining walls. The confining walls have opposite first and second sides 201, 202, a pair of opposite third sides 203 respectively connected to two opposite ends of the first side 201, and a pair of fourth sides 204 each extending inclined between and interconnecting the second side 202 and one of the third sides 203. The first side 201 is longer than the second side 202. The fourth sides 204 are substantially angled away from each other while extending from the second side 202 to the third sides 203. The first and the second sides 201, 202 are substantially parallel. The third sides 203 substantially are perpendicular to the first side 201.

The cavity 21 is spaced apart from the mating face 101 in a front-to-back direction. The cavity 21 has a top wall 211, a bottom inner wall 212 parallel to the top wall 211, and a pair of lateral side walls 213 extending obliquely from the top wall 211 to the bottom inner wall 212. The bottom inner wall 212 is longer than the top wall 211 and disposed between the inserting ports 20 and the cavity 21. The bottom inner wall 212 defines a pair of locking blocks 214 protruding into the cavity 21 for locking the power plug, and a cutout 215 between the locking blocks 214. The cutout 215 extends backwardly from a front end of the bottom inner wall 212 and communicates with the insert ports 20 and the cavity 21 along the up-to-down direction.

The second housing 5 includes a base portion 50, a level mounting pedestal 51 protruding backwardly from a bottom portion of the base portion 50, and a projection 56 protruding backwardly from an upper portion of the base portion 50. The base portion 50 defines a receiving space 501 to receive the standard USB 2.0 B type plug therein, and a tongue 502 disposed in the receiving space 501. The tongue 502 defines two pair of grooves 503 respectively arranged at an upper side and a lower side thereof. The base portion 50 defines a plurality of passageways 504 extending therethrough and communicating with the grooves 503 and a pair of retaining slots 505 extending therethrough and communicating with the receiving space 501. The springs 7 are secured in the retaining slots 505 and disposed on opposite sides of the receiving space 501. The bottom portion of the second housing 5 defines a plurality of posts 54 extending downwardly from the mounting face 102.

The mounting pedestal 51 defines three first recesses 511 and four second recesses 512 all extending downwardly therethrough. Two first recesses 511 are disposed opposite on outer sides of a front end of the mounting pedestal 51. Another first recess 511 are disposed on central of the mounting pedestal 51. The second recess 512 are disposed at a rear end of the mounting pedestal 51. The mounting pedestal 51 defines four level retaining slots 513 respectively arranged at an upper portion thereof. The retaining slots 513 are communicated with second recess 512 along an up-to-down direction.

The projection 56 defines three recessed portions 560 extending therethrough backwardly to fasten the first contacts 2. The recessed portions 560 are arranged in a level surface. The adjacent two recessed portion 560 are staggered with each other along the front-to-back direction and the left-to-right direction.

The first contacts 3 are power contacts for transmitting power signal only. The first contacts 3 each includes a level first securing portion 31 received in the passageway 206 of the first housing 2, a first contact portion 32 extending forwardly into the inserting port 20 from the securing portion 31, a first soldering tail 34 extending downwardly out of the mounting pedestal 51, and a first connecting portion 33 between the first securing portion 31 and the first soldering tail 34. The first connecting portions 33 bend downwardly from the first securing portion 31 in a vertical direction. Two adjacent first connecting portions 33 are staggered with each other in the front-to-back direction and the left-to-right direction. The first connecting portions 33 include an inner connecting portion 33 and two outer first connecting portions 33 bending outwardly with respect to the inner connecting portion 33. The first soldering tails 34 are retained in the first recesses 511 in the left-to-right direction respectively and located at three apexes of an isosceles triangle respectively.

The second contacts 6 are arranged in the receiving space 501 same to that of the standard USB 2.0 B type receptacle. The second contacts 6 includes a pair of upper contacts and a pair of lower contacts. The upper contact and the lower contacts each includes a second securing portion 61 retained in the passageway 504 of the second housing 5, a second contact portion 62 extending forwardly from the second securing portion 61, a second soldering tail 64 extending downwardly out of the mounting pedestal 51, and a second connecting portion 63 between the second securing portion 61 and the second soldering tail 64. The second contact portions 62 are arranged in two groups and respectively received in the grooves 503 of the upper and lower sides of the tongue 502. The second contact portions 62 of the upper contacts cantileveredly extend out of the upper side of the tongue 502. The second contact portion 62 of the lower contacts cantileveredly extend out of the lower side of the tongue 502. The second connection portions 63 each includes a first portion 631, and a level portion 632 bending backwardly from the first portion 631 to the second soldering tail 64. The first portions 631 of the upper contacts extend vertically from the second securing portion 61, then obliquely and outwardly, and finally downwardly to connect with a front end of the level portion 632. The first portion 631 of the lower contacts extend vertically and downwardly to the level portion 632. All the level portion 632 are received in the retaining slots 513 of the mounting pedestal 51 respectively and arranged in a level surface. The second soldering tails 64 are secured by the second recesses 512 along the left-to-right direction and arranged in one row. All the first soldering tails 34 are disposed closer to the mating face 101 than the second soldering tails 64.

The shell 8 is includes a front wall 81, a pair of lateral walls 82 bending backwardly from opposite ends of the front wall 81, and a protruding plate 83 extending upwardly from a top ends of the front wall 81. The front wall 81 defines a opening

811 recessed from the mating face 101 corresponding to the receiving space 501 of the second housing 5. The protrude plating 83 covers a front portion of the first housing 2. The protruding plate 83 is disposed under the inserting ports 20 of the first housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A stacked electrical connector defining a front mating face and a mounting face, comprising:

an insulative housing comprising a first housing and a second housing arranged in an up-to-down direction, the first housing defining a plurality of inserting ports recessed from the mating face, the inserting ports being arranged in a row along a left-to-right direction perpendicular to the up-to-down direction, the second housing defining a receiving space recessed from the mating face; and a plurality of contacts comprising a plurality of first contacts and a plurality of second contacts, wherein the first contacts each has a first securing portion retained in the first housing, a first contact portion extending into the inserting port from the first securing portion, a first soldering tail extending out of the insulative housing downwardly, and a first connecting portion between the first securing portion and the first soldering tail, wherein the second contacts each has a second securing portion retained in the second housing, a second contact portion extending into the receiving space from the second securing portion, a second soldering tail extending out of the insulative housing downwardly, and a second connecting portion between the second securing portion and the second soldering tail; wherein all the first soldering tails are arranged closer to the mating face than the second soldering tails.

2. The stacked electrical connector as claimed in claim 1, wherein the first contacts are power contacts for transmitting power signals.

3. The stacked electrical connector as claimed in claim 1, wherein the first soldering tails are located at three apexes of an isosceles triangle respectively, the second soldering tails are arranged in one row along the left-to-right direction.

4. The stacked electrical connector as claimed in claim 1, wherein the second housing defines a base portion and a mounting pedestal protruding backwardly from the base portion, the mounting surface is located on a bottom portion of the mounting pedestal, the first soldering tails and the second soldering tails are retained by the mounting pedestal in the left-to-right direction.

5. The stacked electrical connector as claimed in claim 4, wherein the second connecting portions each includes a first portion bending downwardly from the second securing portion and a level portion bending from the first portion to the second soldering tail, the first portions are disposed closer to the mating face than at least one of the first connecting portions, the mounting pedestal defines a plurality of retaining slots to receive the level portions.

6. The stacked electrical connector as claimed in claim 1, wherein the first connecting portions bend from the first securing portion downwardly, two adjacent first connecting portions are staggered with each other in the front-to-back direction and the left-to-right direction, the first connecting portions include an inner connecting portion and two outer connecting portions bending outwardly with respect to the inner connecting portion.

7. The stacked electrical connector as claimed in claim 1, wherein the first housing defines a cavity disposed above the inserting ports for receiving a first plug while the first plug inserted into the inserting ports, and a bottom inner wall disposed between the cavity and the inserting ports, the bottom inner wall defines a pair of locking blocks protruding into the cavity for locking with the first plug and a cutout between the locking blocks, the cutout extends backwardly from a front end of the bottom inner wall and communicates with the inserting port and the cavity along the up-to-down direction.

8. The stacked electrical connector as claimed in claim 1, wherein the second housing defines a tongue extending into the receiving space, the second contacts include a pair of upper contacts and a pair of lower contacts, The second contact portions of the upper contacts cantileveredly extend out of an upper side of the tongue, the second contact portions of the lower contacts cantileveredly extend out of a lower side of the tongue, the second connecting portions of the upper contacts each includes a first portion bending from the second securing portion, and a level portion bending backwardly from the first portion to the second soldering tail, the first portions extend vertically and downwardly from the second securing portion, then obliquely and outwardly, and finally downwardly to connect with a front end of the level portion.

9. The stacked electrical connector as claimed in claim 1, wherein the receiving space is substantially same as that of a standard USB 2.0 B type receptacle, the second contacts are arranged in the receiving space to mate with a standard USB 2.0 B type plug.

10. The stacked electrical connector as claimed in claim 1, wherein the second housing defines a projection protruding backwardly from a top portion thereof, the projection defines three recessed portions extending therethrough backwardly to fasten the first securing portions respectively, the recessed portions are arranged in a level surface, two adjacent recessed portion are staggered with each other along the front-to-back direction and the left-to-right direction.

11. The stacked electrical connector as claimed in claim 1, further comprising a metal shell covering the second housing, the shell has a front wall, a pair of lateral walls bending backwardly from opposite ends of the front wall, and a protruding plate extending upwardly from the front wall, the protruding plate covers a front portion of the first housing, the protruding plate is disposed under the inserting ports.

12. A stacked electrical connector defining a front mating face and a mounting face perpendicular to the mating face, comprising:

an insulative housing comprising a first housing and a second housing arranged in an up-to-down direction, the first housing defining a plurality of inserting ports recessed from the mating face; and a plurality of contacts comprising a plurality of first contacts and a plurality of second contacts, wherein the first contacts each has a first securing portion retained in the first housing, a first contact portion extending into the inserting port from the first securing portion, a first soldering tail extending out of the insulative housing, and a first connecting portion between the first securing portion and the first soldering tail, wherein the second contacts each has a second securing portion retained in the second housing, a second contact portion extending into the receiving space from the second securing portion, a second soldering tail extending downwardly and out of the insulative housing, and a second connecting portion between the second securing portion and the second soldering tail;

wherein the second housing defines a base portion and a mounting pedestal protruding backwardly from the base portion, the mounting surface is disposed on a bottom portion of the mounting pedestal, the first soldering tails and the second soldering tails are fixed on the mounting pedestal in a left-to-right direction;

wherein the mounting pedestal further defines a plurality of level retaining slots, the second connecting portion each includes a level portion connecting with the second soldering tail, the level portions are received in the retaining slots.

13. The stacked electrical connector as claimed in claim 12, wherein the second tails are arranged in one row along the left-to-right direction.

14. The stacked electrical connector as claimed in claim 12, wherein the first contacts are power contact for transmitting power signals, the first soldering tail are arranged in three apexes of an isosceles triangle respectively, all the first soldering tails are disposed closer to the mating face the second soldering tails.

15. The stacked electrical connector as claimed in claim 12, wherein the first housing defines a cavity disposed above the inserting ports, and a locking block extending into the cavity for locking with a plug while the plug inserted in the inserting ports, the cavity is spaced apart from the mating face in a front-to-back direction, the cavity has a top wall, a bottom inner wall parallel to the top wall, and a pair of lateral side walls extending obliquely from the top wall to the bottom inner wall, the bottom inner wall is longer than the top wall, the bottom inner wall is disposed between the inserting ports and the cavity.

* * * * *